US007950912B2

(12) United States Patent
Sato et al.

(10) Patent No.: US 7,950,912 B2
(45) Date of Patent: May 31, 2011

(54) SCROLL COMPRESSOR HAVING A GRADUALLY CHANGING TIP CLEARANCE

(75) Inventors: Hajime Sato, Aichi (JP); Taichi Tateishi, Aichi (JP); Yoshiyuki Kimata, Aichi (JP); Yoshiaki Miyamoto, Aichi (JP); Yogo Takasu, Aichi (JP)

(73) Assignee: Mitsubishi Heavy Industries, Ltd., Tokyo (JP)

( * ) Notice: Subject to any disclaimer, the term of this patent is extended or adjusted under 35 U.S.C. 154(b) by 583 days.

(21) Appl. No.: 11/989,861

(22) PCT Filed: Dec. 27, 2007

(86) PCT No.: PCT/JP2007/075211

§ 371 (c)(1),
(2), (4) Date: Feb. 1, 2008

(87) PCT Pub. No.: WO2008/081906

PCT Pub. Date: Jul. 10, 2008

(65) Prior Publication Data

US 2010/0092318 A1 Apr. 15, 2010

(30) Foreign Application Priority Data

Dec. 28, 2006 (JP) ..... 2006-356170

(51) Int. Cl.
*F03C 2/00* (2006.01)
*F03C 4/00* (2006.01)
*F04C 2/00* (2006.01)

(52) U.S. Cl. ..... 418/55.2; 418/55.4; 418/142

(58) Field of Classification Search ..... 418/55.1–55.6, 418/57, 140, 142
See application file for complete search history.

(56) References Cited

U.S. PATENT DOCUMENTS 6,659,745 B2 * 12/2003 Fujita et al. ..... 418/55.2
7,344,365 B2 * 3/2008 Takeuchi et al. ..... 418/55.2

FOREIGN PATENT DOCUMENTS

JP 58-67902 A 4/1983

(Continued)

OTHER PUBLICATIONS

International Search Report of PCT/JP2007/075211, date of mailing date Feb. 12, 2008.

*Primary Examiner* — Theresa Trieu
(74) *Attorney, Agent, or Firm* — Westerman, Hattori, Daniels & Adrian, LLP

(57) ABSTRACT

A scroll compressor performing three-dimensional compressions, which can optimize a tip clearance in operation while considering a thermal expansion and a pressure deformation and which can reduce a compression leakage to improve a compression efficiency thereby to realize a high performance. The leading end faces (13*c* and 13*d*) and the bottom face of a spiral wrap (13*b*) have a step portion (13*e*), and the wrap height on the outer circumference side of the spiral wrap (13*b*) is made larger than that on the inner circumference side wrap height. The spiral wrap (13*b*) on the inner circumference side with respect to the step portion (13*e*) is stepwise or continuously made gradually lower toward the center side of the spiral wrap (13*b*), and the tip clearance (Δi) of the spiral wrap on the inner circumference side with respect to the step portion (13) is made gradually larger toward the center side of the spiral wrap (13*b*).

15 Claims, 6 Drawing Sheets

FOREIGN PATENT DOCUMENTS

| | | | |
|---|---|---|---|
| JP | 59-176483 | A | 10/1984 |
| JP | 7-19187 | A | 1/1995 |
| JP | 7-35061 | A | 2/1995 |
| JP | 7-197891 | A | 8/1995 |
| JP | 2002-5052 | A | 1/2002 |
| JP | 2003-35285 | A | 2/2003 |
| JP | 2006-342776 | A | 12/2006 |

* cited by examiner

SCROLL COMPRESSOR HAVING A GRADUALLY CHANGING TIP CLEARANCE

TECHNICAL FIELD

The present invention relates to a scroll compressor, in which the outer circumference side wrap of spiral wraps of a scroll member is set higher than the inner circumference side wrap so that it can perform three-dimensional compressions, which can perform compression in the circumferential direction of the spiral wraps and in the wrap height direction.

BACKGROUND ART

In recent years, there has been developed a scroll compressor which includes a fixed scroll member having a fixed spiral wrap erected on one face of a fixed end plate, and an orbiting scroll member having an orbiting spiral wrap erected on one face of an orbiting end plate and assembled in a manner capable of orbiting, while being blocked from rotation, with respect to the fixed scroll member. The fixed scroll member and the orbiting scroll member individually include step portions on the leading end faces and the bottom faces of their individual spiral wraps such that the spiral wraps have a higher wrap height on the outer circumference side than that on the inner circumference side. The scroll compressor is enabled to perform three-dimensional compressions capable of compressing in the circumferential direction of the spiral wraps and in the wrap height direction.

The aforementioned scroll compressor is featured in that the compression ratio can be increased to improve the compression performance without enlarging the external diameter of the compressor.

With the scroll compressor, in connection with the setting of such a tip clearance between the leading end face of the spiral wrap and the bottom face as influences the gas leakage at a compression process to vary a compression efficiency, it has been proposed (as referred to Patent Documents 1 and 2) by considering the level of the thermal expansions of the paired scroll members that the tip clearance on the inner circumference side with respect to the step portion of the spiral wrap is made larger than the tip clearance on the outer circumference side with respect to the step portion.

[Patent Document 1] JP-A-2002-5052

[Patent Document 2] JP-A-2003-035285

DISCLOSURE OF INVENTION

By varying the magnitude of the tip clearances between the outer circumference side and the inner circumference side of the step portion thereby to make the tip clearance on the inner circumference side larger, as described above, the tip clearances in operation can be optimized to some extent while considering the thermal expansion. As a result, the gas leakage at the compressing process can be reduced to improve the compression efficiency.

In connection with the influences by the thermal expansion, however, the scroll compressors of the aforementioned Patent Documents have found it difficult to follow the continuous temperature gradient from an intake temperature to a discharge temperature and still insufficient to optimize the tip clearance in a manner to match the temperature gradient thereby to improve the compression performance. In case the step portions are formed at the leading end faces and the bottom faces of the spiral wraps in the scroll members, moreover, the end plates are thin on the outer circumference side and thick on the inner circumference side, so that the pressure deformations of the end plates are not related unlike those of the uniform end plate thickness such the pressure rise and the deformation are substantially proportional. This makes it necessary to set the tip clearances considering those situations.

The present invention has been conceived in view of the backgrounds thus far described, and has an object to provide a scroll compressor capable of performing three-dimensional compressions, which can optimize a tip clearance in operation while considering a thermal expansion and a pressure deformation and which can reduce a compression leakage to improve a compression efficiency thereby to realize a high performance.

In order to solve the aforementioned problem, the scroll compressor of the present invention adopts the following solutions.

A scroll compressor according to a first aspect of the present invention includes: a fixed scroll member having a fixed spiral wrap erected on one face of a fixed end plate; and an orbiting scroll member having an orbiting spiral wrap erected on one face of an orbiting end plate and assembled in a manner capable of orbiting, while being blocked from rotation, with respect to the fixed scroll member, the fixed scroll member and the orbiting scroll member individually including step portions on the leading end faces and the bottom faces of their individual spiral wraps such that the spiral wraps have a higher wrap height on the outer circumference side than that on the inner circumference side, and the scroll compressor being enabled to perform three-dimensional compressions capable of compressing in the circumferential direction of the spiral wraps and in the wrap height direction, in which the spiral wrap, at least on the inner circumference side with respect to the step portions, is stepwise or continuously made gradually lower toward the center side of the spiral wrap, and in which the tip clearance of the spiral wrap, at least on the inner circumference side with respect to the step portions, is made gradually larger toward the center side of the spiral wrap.

In the scroll compressor, in which the spiral wrap is equipped with the step portion individually at its leading end face and its bottom face and made higher on the outer circumference side in the spiral wrap so that the scroll compressor can be three-dimensionally compressed in the circumferential direction and in the height direction of the spiral wrap, the thermal expansion of the spiral wrap is made larger in substantial proportion to the temperature at the center side of the inner circumference side spiral wrap with respect to the step portion. Moreover, the pressure deformation of the end plate is not always larger in proportion to the pressure but is relatively smaller because the end plate on the inner circumference side is thicker and less deformable with respect to the step portion. In a manner to match this, according to the present invention, the inner circumference side spiral wrap is stepwise or continuously made gradually lower toward the center side, and the tip clearance is made gradually larger toward the center side of the spiral wrap. In a manner to match the continuous temperature gradient in the high-pressure range and in the high-temperature range, therefore, the tip clearance in operation in the spiral direction of the inner circumference side spiral wrap can be optimized and reduced. As a result, the gas leakage from the tip clearance in the high-pressure range can be reduced to improve the compression efficiency effectively thereby to give a high performance to the scroll compressor capable of performing the three-dimensional compressions.

A scroll compressor according to a second aspect of the present invention includes: a fixed scroll member having a fixed spiral wrap erected on one face of a fixed end plate; and an orbiting scroll member having an orbiting spiral wrap erected on one face of an orbiting end plate and assembled in a manner capable of orbiting, while being blocked from rotations, with regard to the fixed scroll member, the fixed scroll member and the orbiting scroll member individually including step portions on the leading end faces and the bottom faces of their individual spiral wraps such that the spiral wraps have a higher wrap height on the outer circumference side than that on the inner circumference side, and the scroll compressor being enabled to perform three-dimensional compressions capable of compressing in the circumferential direction of the spiral wrap and in the wrap height direction, in which the spiral wrap on the outer circumference side with respect to the step portions and the spiral wrap on the inner circumference side are individually stepwise or continuously made gradually lower toward the center side of the spiral wrap, and in which the individual tip clearances of the spiral wrap are individually made gradually larger from the outer circumference side of the spiral wrap toward the center side.

In the scroll compressor, in which the spiral wrap is equipped with the step portion individually at its leading end face and its bottom face and made higher on the outer circumference side in the spiral wrap so that the scroll compressor can be three-dimensionally compressed in the circumferential direction and in the height direction of the spiral wrap, the thermal expansion of the spiral wrap is made larger in substantial proportion to the temperature at the center side of the inner circumference side spiral wrap with respect to the step portion. Moreover, the pressure deformation of the end plate is not always larger in proportion to the pressure but is relatively smaller because the end plate on the inner circumference side is thicker and less deformable with respect to the step portion. In a manner to match this, according to the present invention, the outer circumference side and inner circumference side spiral wrap is stepwise or continuously made gradually lower toward the center side, and the tip clearance is made gradually larger from the outer circumference side toward the center side of the spiral wrap. In a manner to match the continuous temperature gradient from the intake to the discharge, therefore, the tip clearance in operation in the spiral direction of the outer circumference side and inner circumference side spiral wrap can be optimized and reduced in a whole range. As a result, the gas leakage from the tip clearance in the whole range from the intake to the discharge can be reduced to improve the compression efficiency thereby to give a high performance to the scroll compressor capable of performing the three-dimensional compressions.

A scroll compressor of a third aspect of the present invention is according to any of the aforementioned scroll compressors, in which the maximum tip clearance $\Delta o$ of the spiral wrap on the outer circumference side with respect to the step portions and the minimum tip clearance $\Delta i$ of the spiral wrap on the inner circumference side with respect to the step portions are made to have a relation of $\Delta o \leqq \Delta i$.

In order to match the continuous temperature gradient from the intake to the discharge, according to the third aspect of the present invention, the maximum tip clearance $\Delta o$ of the outer circumference side spiral wrap and the minimum tip clearance $\Delta i$ of the inner circumference side spiral wrap are made to have a relation of $\Delta o \leqq \Delta i$. Therefore, the tip clearance from the outermost circumference to the innermost circumference of the spiral wrap can be stepwise or continuously made gradually larger. As a result, over the whole range from the outermost circumference to the innermost circumference of the spiral wrap, the tip clearance in operation can be optimized and reduced as a whole.

A scroll compressor of a fourth aspect of the present invention is according to any of the aforementioned scroll compressors, in which a gradient Eo at the time when the spiral wrap on the outer circumference side with respect to the step portions is stepwise or continuously made gradually lower toward the center side of the spiral wrap and a gradient Ei at the time when the spiral wrap on the inner circumference side with respect to the step portions is stepwise or continuously made gradually lower toward the center side of the spiral wrap are made to have a relation of $Eo<Ei$.

In order to match the continuous temperature gradient from the intake to the discharge, according to the fourth aspect of the present invention, the gradient Eo at the time when the outer circumference side spiral wrap is stepwise or continuously made gradually lower and the gradient Ei at the time when the inner circumference spiral wrap is stepwise or continuously made gradually lower are made to have the relation of $Eo<Ei$. Therefore, the tip clearance from the outermost circumference to the innermost circumference of the spiral wrap can be stepwise or continuously made gradually larger, and the spiral wrap on the inner circumference side can be made gradually larger at the larger gradient. As a result, over the whole range from the outermost circumference to the innermost circumference of the spiral wrap, the tip clearance in operation can be optimized and reduced as a whole.

A scroll compressor of a fifth aspect of the present invention is according to any of the aforementioned scroll compressors, in which the gradient at the time when the inner circumference side spiral wrap is stepwise or continuously made gradually lower toward the center side of the spiral wrap is made gradually larger toward the center side of the spiral wrap.

In order to match the continuous temperature gradient from the intake to the discharge, according to the fifth aspect of the present invention, the gradient at the time when the inner circumference side spiral wrap is stepwise or continuously made gradually lower is made gradually larger toward the center side of the spiral wrap. Therefore, the tip clearance from the outermost circumference to the innermost circumference of the spiral wrap can be stepwise or continuously made gradually larger, and the spiral wrap on the inner circumference side can be made gradually larger at the larger gradient. As a result, over the whole range from the outermost circumference to the innermost circumference of the spiral wrap, the tip clearance in operation can be optimized and reduced as a whole.

A scroll compressor of a sixth aspect of the present invention is according to any of the aforementioned scroll compressors, in which a tip seal member is fitted in a tip seal groove formed in the leading end face of the spiral wrap, at least on the inner circumference side with respect to the step portions, and in which one of steps for varying the tip clearance stepwise is disposed in the vicinity of the outer circumference end side at the position where the tip seal member is fitted.

According to the sixth aspect of the present invention, the step portion between the outer circumference side spiral wrap and the inner circumference side spiral wrap causes the tip seal member to form a cut portion, which forms one of the height differences for varying the tip clearance at the position close to the outer circumference end side of the tip seal member to make the tip clearance larger. By that height difference, it is made possible to reduce the tip clearance at the outer circumference end portion of the inner circumference side spiral wrap with respect to the step portion. As a result, the gas leakage at that portion can be reduced to improve the compression efficiency.

A scroll compressor of a seventh aspect of the present invention is according to the aforementioned scroll compressor, in which the height difference is made higher than the others for varying the tip clearance stepwise.

According to the seventh aspect of the present invention, the height difference formed at the outer circumference end portion of the inner circumference side spiral wrap is made higher than the remaining height differences so that the tip clearance of the cut portion of the tip seal member can be more effectively reduced. As a result, the gas leakage at that portion can be more reduced to improve the compression efficiency.

A scroll compressor according to an eighth aspect of the present invention includes: a fixed scroll member having a fixed spiral wrap erected on one face of a fixed end plate; and an orbiting scroll member having an orbiting spiral wrap erected on one face of an orbiting end plate and assembled in a manner capable of orbiting, while being blocked from rotations, with regard to the fixed scroll member, the fixed scroll member and the orbiting scroll member individually including step portions on the leading end faces and the bottom faces of their individual spiral wraps such that the spiral wraps have a higher wrap height on the outer circumference side than that on the inner circumference side, a tip seal member being fitted in a tip seal groove formed in the leading end face of each of the spiral wraps, and the scroll compressor being enabled to perform three-dimensional compressions capable of compressing in the circumferential direction of the spiral wrap and in the wrap height direction, in which the height difference $\epsilon 1$ between the top faces of the outer circumference side tip seal member fitted in the spiral wrap on the outer circumference side with respect to the step portions and the wrap leading end faces and the height difference $\epsilon 2$ between the top faces of the inner circumference side tip seal member fitted in the spiral wrap on the inner circumference side with respect to the step portions and the wrap leading end faces are made to have a relation of $\epsilon 1<\epsilon 2$.

In the scroll compressor, in which the spiral wrap is equipped with the step portion individually at its leading end face and its bottom face and made higher on the outer circumference side in the spiral wrap so that the scroll compressor can be three-dimensionally compressed in the circumferential direction and in the height direction of the spiral wrap, the thermal expansion of the spiral wrap is made larger in substantial proportion to the temperature at the center side of the inner circumference side spiral wrap with respect to the step portion. Moreover, the pressure deformation of the end plate is not always larger in proportion to the pressure but is relatively smaller because the end plate on the inner circumference side is thicker and less deformable with respect to the step portion. Likewise, the tip seal member to be fitted in the leading end face of the spiral wrap also expands thermally, and the tip seal member is generally made of a resin so that it has a higher linear thermal expansion than that of the metallic spiral wrap. In a manner to match those facts, according to the present invention, the height difference $\epsilon 1$ between the top face of the outer circumference side tip seal member and the wrap leading end face and the height difference $\epsilon 2$ between the top face of the inner circumference side tip seal member and the wrap leading end face are made to have the relation of $\epsilon 1<\epsilon 2$. Therefore, the tip clearances, which are determined by the thermal expansions of the tip seal members in operation of the outer circumference side spiral wrap and the inner circumference side spiral wrap can be individually optimized and reduced as a whole. As a result, the gas leakages from the tip clearances can be reduced to improve the compression efficiency thereby to give a high performance to the scroll compressor capable of performing the three-dimensional compressions.

A scroll compressor of a ninth aspect of the present invention is according to the aforementioned scroll compressor, in which the inner circumference side tip seal groove formed in the spiral wrap on the inner circumference side with respect to the step portion is stepwise or continuously made gradually deeper toward the center side of the spiral wrap, and the height difference $\epsilon 2$ is made gradually larger from the outer circumference side of the spiral wrap toward the center side.

In a manner to match the fact that the thermal expansion is the larger as the closer to the center side of the tip seal member to be fitted in the spiral wrap on the inner circumference side with respect to the step portion, according to the ninth aspect of the present invention, the inner circumference side tip seal groove is stepwise or continuously made gradually deeper toward the center side of the spiral wrap, and the height difference $\epsilon 2$ is made gradually larger from the outer circumference side of the spiral wrap toward the center side. In a manner to match the continuous temperature gradient in the high-temperature range in the high-pressure range, therefore, the tip clearance, which is determined by the thermal expansion of the tip seal member in operation of the inner circumference side spiral wrap, can be optimized and reduced. As a result, the gas leakage from the tip clearance in the high-pressure range can be reduced to improve the compression efficiency effectively.

A scroll compressor of a tenth aspect of the present invention is according to the aforementioned scroll compressor, in which the outer circumference side tip seal groove formed in the spiral wrap on the outer circumference side with respect to the step portion and the inner circumference side tip seal groove formed in the spiral wrap on the inner circumference side with respect to the step portion are stepwise or continuously made gradually deeper toward the center sides of the individual spiral wraps, and in which the height differences $\epsilon 1$ and $\epsilon 2$ are made gradually larger from the outer circumference side of the individual spiral wraps toward the center sides.

According to the tenth aspect of the present invention, in a manner to match the fact that the thermal expansions of the outer circumference side and inner circumference side tip seal members to be fitted in the spiral wraps on the outer circumference side and the inner circumference side are made gradually larger from the center side on the outer circumference side toward the center side on the inner circumference side, the outer circumference side tip seal groove and the inner circumference side tip seal groove are stepwise or continuously made gradually deeper toward the center sides of the spiral wraps, and the height differences $\epsilon 1$ and $\epsilon 2$ are made gradually larger from the outer circumference side of the spiral wraps toward the center sides. In a manner to match the continuous temperature gradient from the intake to the discharge, therefore, the tip clearances, which are determined by the thermal expansion of the tip seal members in operation in the spiral direction of the inner circumference side and outer circumference side spiral wraps, can be optimized over the whole range and reduced. As a result, the gas leakage from the tip clearance in the whole range from the intake to the discharge can be reduced to improve the compression efficiency.

A scroll compressor of an eleventh aspect of the present invention is according to any of the aforementioned scroll compressors, in which, in a manner to match the fact that the inner circumference side tip seal groove is stepwise or continuously made gradually deeper toward the center side of the spiral wrap, the spiral wrap on the inner circumference side with respect to the step portion is stepwise or continuously made gradually lower toward the center side of the spiral wrap, and in which a gradient Eg at the time when the inner circumference side tip seal groove is stepwise or continuously made gradually deeper toward the center side of the spiral wrap and a gradient Er at the time when the spiral wrap is stepwise or continuously made gradually lower toward the center side of the spiral wrap are made to have a relation of Eg>Er.

According to the eleventh aspect of the present invention, in a manner to match the fact that the thermal expansion of the inner circumference side tip seal member to be fitted in the spiral wrap on the inner circumference side is gradually the larger as the closer to the center side and that the inner circumference side tip seal groove is stepwise or continuously made gradually deeper toward the center side, the spiral wrap is stepwise or continuously made gradually lower toward the center side, and the gradient Eg at the time when the inner circumference side tip seal groove is stepwise or continuously made gradually deeper toward the center side and the gradient Er at the time when the spiral wrap is stepwise or continuously made gradually lower toward the center side are made to have the relation of Eg>Er. In a manner to match the continuous temperature gradient in the high-pressure and high-temperature range, therefore, the tip clearances, which are determined by the thermal expansion of the tip seal members in operation in the spiral direction of the inner circumference side and outer circumference side spiral wraps, can be optimized over the whole range and reduced. As a result, the gas leakage from the tip clearance in the high-pressure range can be reduced to improve the compression efficiency.

A scroll compressor of a twelfth aspect of the present invention is according to any of the aforementioned scroll compressors, in which, in a manner to match the fact that the inner circumference side and outer circumference side tip seal grooves are stepwise or continuously made gradually deeper toward the center sides of the spiral wraps, the spiral wrap on the inner circumference side and on the outer circumference side with respect to the step portions are stepwise or continuously made gradually lower toward the center sides of the spiral wraps, and in which a gradient Eg at the time when the inner circumference side and outer circumference side tip seal grooves are stepwise or continuously made gradually deeper toward the center sides of the spiral wraps and a gradient Er at the time when the inner circumference and outer circumference spiral wraps are stepwise or continuously made gradually lower toward the center sides of the spiral wraps are individually made to have a relation of Eg>Er.

According to the twelfth aspect of the present invention, in a manner to match the fact that the thermal expansion of the outer circumference side and inner circumference side tip seal members fitted in the spiral wraps on the outer circumference side and the inner circumference side are gradually the larger as the closer to the center side on the inner circumference from the outer circumference side, and that the inner circumference side and outer circumference side tip seal grooves are stepwise and continuously made gradually deeper toward the center side, the spiral wraps are stepwise or continuously made gradually lower toward the center sides. The gradient Eg at the time when the inner circumference side and the outer circumference side tip seal grooves are stepwise or continuously made gradually deeper toward the center sides and the gradient Er at the time when the spiral wrap is stepwise or continuously made gradually lower toward the center side are made to have the relation of Eg>Er. In a manner to match the continuous temperature gradient from the intake to the discharge, therefore, the tip clearances, which are determined by the thermal expansion of the tip seal members in operation in the spiral direction of the inner circumference side and outer circumference side spiral wraps, can be optimized over the whole range and reduced. As a result, the gas leakage from the tip clearances in the whole range from the intake to the discharge can be reduced to improve the compression efficiency.

A scroll compressor of a thirteenth aspect of the present invention is according to the aforementioned scroll compressor, in which the outer circumference side tip seal groove formed in the spiral wrap on the outer circumference side with respect to the step portion is stepwise or continuously made gradually deeper toward the center side of the spiral wrap, in which the height difference $\epsilon 1$ is made gradually larger from the outer circumference side to the inner circumference side of the spiral wrap, in which, in a manner to match the fact that the tip seal groove formed in the inner circumference side spiral wrap with respect to the step portion is stepwise or continuously made gradually deeper toward the center side of the spiral wrap, the spiral wrap on the inner circumference side with respect to the step portion is stepwise or continuously made gradually lower toward the center side of the spiral wrap, and in which a gradient Eg at the time when the inner circumference side tip seal groove is stepwise or continuously made gradually deeper toward the center side of the spiral wrap and a gradient Er at the time when the spiral wrap is stepwise or continuously made gradually lower toward the center side of the spiral wrap are made to have a relation of Eg>Er.

According to the thirteenth aspect of the present invention, the outer circumference side tip seal groove with respect to the step portion is stepwise or continuously made gradually deeper toward the center side of the spiral wrap, and the height difference $\epsilon 1$ is made gradually larger from the outer circumference side to the inner circumference of the spiral wrap toward the center side. In a manner to match the fact that the inner circumference side tip seal groove with respect to the step portion is stepwise and continuously made gradually deeper toward the center side of the spiral wrap, the spiral wrap is stepwise or continuously made gradually lower toward the center side of the spiral wrap. The gradient Eg at the time when the inner circumference side tip seal groove is stepwise or continuously made gradually deeper toward the center side and the gradient Er at the time when the spiral wrap is stepwise or continuously made gradually lower toward the center side are made to have the relation of Eg>Er. In a manner to match a relatively small temperature gradient on the outer circumference side and a relatively high temperature gradient on the inner circumference side, therefore, the tip clearances in operation on the outer circumference side and the inner circumference side of the spiral wraps can be optimized to match the individual temperature gradients and can be made as small as possible.

As a result, the gas leakage from the tip clearances in the whole range from the intake to the discharge can be reduced to improve the compression efficiency.

In a manner to match the continuous temperature gradient from the intake to the discharge, according to the present invention, the tip clearance in operation in the spiral direction of the spiral wrap can be optimized and reduced. As a result, the gas leakage from the tip clearance can be reduced to improve the compression efficiency thereby to realize a high performance.

EXPLANATION OF REFERENCE

S: Scroll Compressor
12: Fixed Scroll Member
12*a*: End Plate
12*b*: Spiral Wrap
12*c*, 12*d*: Leading End Face
12*e*, 12*h*: Step Portion
12*f*, 12*g*: Bottom Face
13: Orbiting Scroll Member
13*a*: Step Plate
13*b*: Spiral Wrap
13*c*, 13*d*: Leading End Face
13*e*, 13*h*: Step Portion
13*f*, 13*g*: Bottom Face
14*a*, 14*b*, 15*a*, 15*b*: Tip Seal Member
14*c*, 14*d*, 15*c*, 15*d*: Tip Seal Groove
Δo, Δi: Tip Clearance
δo, δi, δi1, δi2, δi3, δi5, δi6, δiN: Height Difference
εo, εi, εi1, εi2, εi3, εiN: Height Difference

BEST MODE FOR CARRYING OUT THE INVENTION

In the following, embodiments according to the present invention are described with reference to the accompanying drawings.

First Embodiment

In the following, a first embodiment of the present invention is described with reference to FIG. 1 to FIG. 4.

Figure 1:
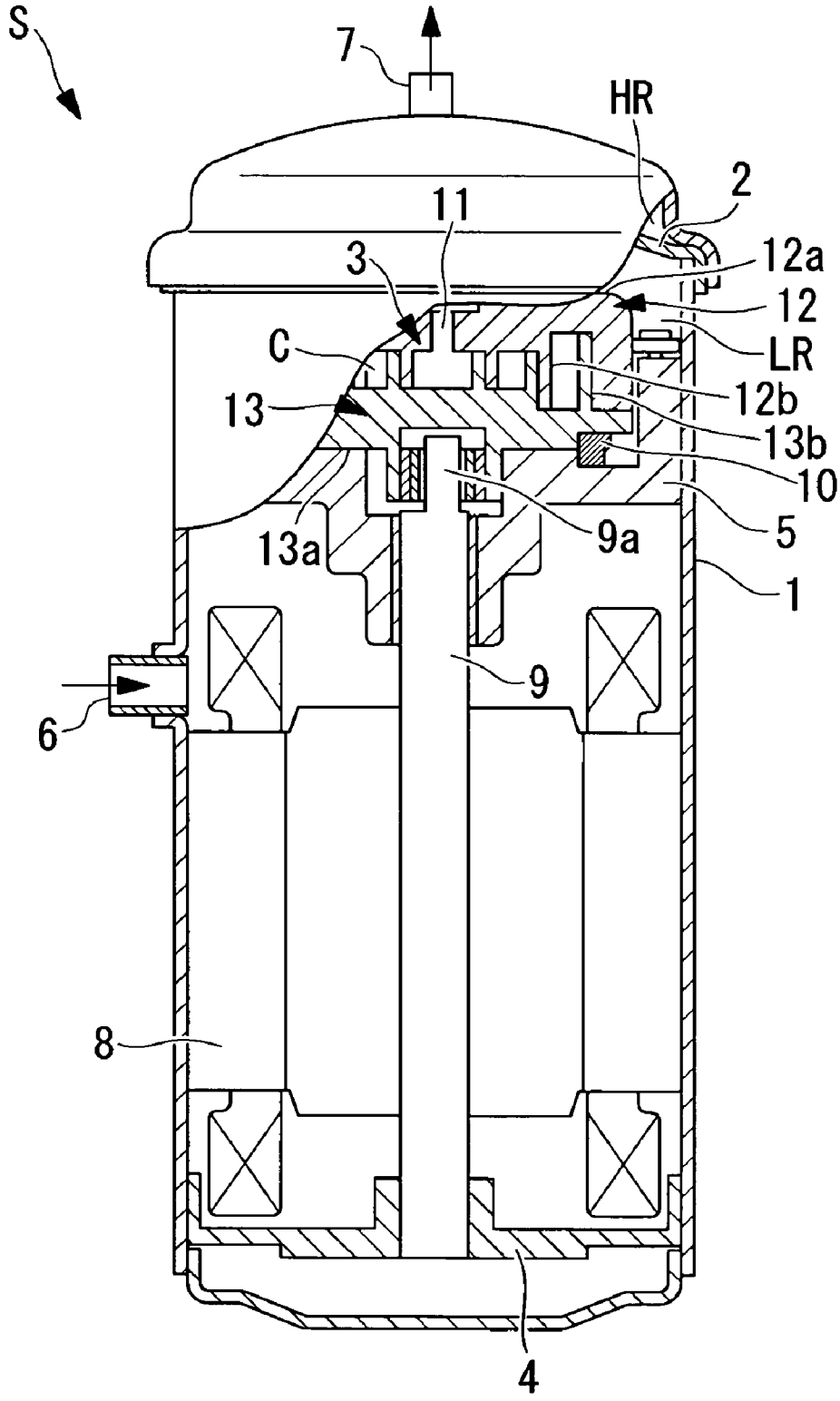
FIG. 1 is a partially sectional, longitudinal view of a scroll compressor according to a first embodiment of the present invention.

FIG. 1 shows a partially sectional, longitudinal view of a scroll compressor S. This scroll compressor S is a sealed type scroll compressor S having a sealed housing 1. This sealed housing 1 is equipped therein with a discharge cover 2 for separating the inside of the sealed housing 1 into a high-pressure chamber HR and a low-pressure chamber LR. The side of the low-pressure chamber LR is equipped with a compression mechanism 3 and an electric motor 8, and is connected to an intake pipe 6. On the other hand, the side of the high-pressure chamber HR is connected with a discharge pipe 7.

The compression mechanism 3 is mounted on a frame 5, which is fixed in the sealed housing 1 in the low-pressure chamber LR. This compression mechanism 3 is connected to the electric motor 8 by a crankshaft 9, which is supported through a bearing (not shown) on the frame 5 and a lower frame 4, so that it is driven by the rotations of the electric motor 8.

The compression mechanism 3 includes a pair of fixed scroll member 12 and an orbiting scroll member 13 meshed with the fixed scroll 12 to form a compression chamber C. The fixed scroll member 12 is equipped with a discharge port 11 at its central portion and is fixed on the frame 5. On the other hand, the orbiting scroll member 13 is jointed through a drive bushing to a crankpin 9*a* formed at one end of the crankshaft 9, and is disposed in a manner capable of orbiting while being blocked from its rotation on the frame 5 through a rotation blocking mechanism 10 such as an Oldham ring.

Figure 2A:
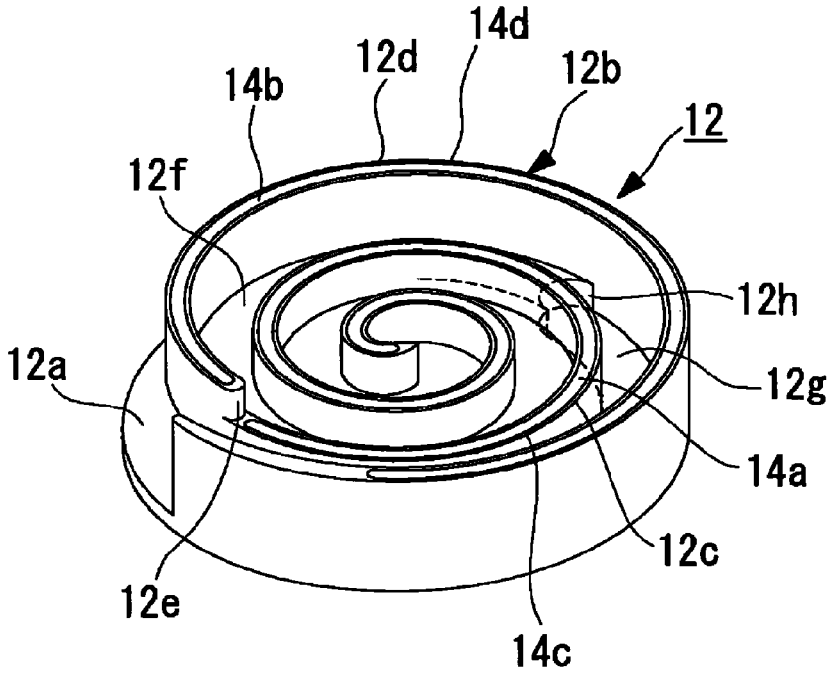
FIG. 2A is a perspective view of a fixed scroll member of the scroll compressor shown in FIG. 1.
Figure 2B:
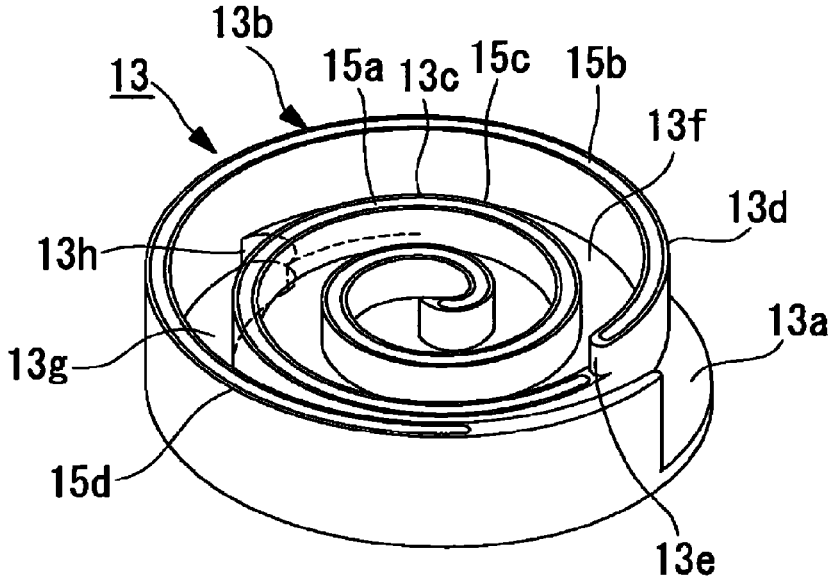
FIG. 2B is a perspective view of an orbiting scroll member of the scroll compressor shown in FIG. 1.

The fixed scroll member 12 is constituted, as shown in FIG. 2A, such that a spiral wrap 12*b* is erected on one side face of an end plate 12*a*. The orbiting scroll member 13 is constituted, as shown in FIG. 2B, like the fixed scroll member 12, such that a spiral wrap 13*b* is erected on one side face of an end plate 13*a*. Especially the spiral wrap 13*b* has substantially the same shape as that of the spiral wrap 12*b* on the side of the fixed scroll member 12. The orbiting scroll member 13 is so assembled by meshing the spiral wraps 12*b* and 13*b* that it is made eccentric only by a radius of orbiting with respect to the fixed scroll member 12 and shifted in phase by 180 degrees.

The end plate 12*a* of the fixed scroll member 12 is equipped, on one side face erecting the spiral wrap 12*b*, with a step portion 12*h*, which is made higher on the inner circumference side and lower on the outer circumference side along the spiral direction of the spiral wrap 12*b*. Like the end plate 12*a* of the fixed scroll member 12, the end plate 13*a* of the orbiting scroll member 13 side is equipped, on one side face erecting the spiral wrap 13*b*, with a step portion 13*h*, which is made higher on the inner circumference side and lower on the outer circumference side along the spiral direction of the spiral wrap 13*b*. The individual step portions 12*h* and 13*h* are formed at an advanced position of π (rad.) from the outer circumference ends (on the intake side) to the inner circumference ends (on the discharge side) of the individual spiral wraps 12*b* and 13*b*, for example, with respect to the spiral centers of the individual spiral wraps 12*b* and 13*b*.

The bottom face (bottom land) of the end plate 12*a* is divided by the step portion 12*h* into two portions of a shallow bottom face 12*f* formed on the inner circumference side and a deep bottom face 12*g* formed on the outer circumference side. A vertical joint face forming the step portion 12*h* exists between those adjoining bottom faces 12*f* and 12*g*.

Like the aforementioned end plate 12*a*, the bottom face (bottom land) of the end plate 13*a* is divided by the step portion 13*h* into two portions of a shallow bottom face 13*f* formed on the inner circumference side and a deep bottom face 13*g* formed on the outer circumference side. A vertical joint face forming the step portion 13*h* exists between those adjoining bottom faces 13*f* and 13*g*.

Moreover, the spiral wrap 12*b* on the side of the fixed scroll member 12 has its leading end face (tip face) divided into two portions in a manner to correspond to the step portion 13*h* of the orbiting scroll member 13, and is equipped with a step portion 12*e* made lower on the inner circumference side of the spiral direction but higher on the outer circumference side. Like the spiral wrap 12*b*, the spiral wrap 13*b* on the side of the orbiting scroll member 13 has its leading end face (or tip face) of the spiral wrap 13*b* divided into two portions in a manner to correspond to the step portion 12*h* of the fixed scroll member 12, and is equipped with a step portion 13*e* made lower on the inner circumference side of the spiral direction but higher on the outer circumference side.

Specifically, the leading end face of the spiral wrap 12*b* is divided by the step portion 12*e* into the two portions of a lower leading end face 12*c* formed on the inner circumference side and a higher leading end face 12*d* formed on the outer circumference side, and a vertical joint face forming the step portion 12*e* is present between those adjoining leading end faces 12*c* and 12*d*. Like the aforementioned spiral wrap 12*b*, the leading end face of the spiral wrap 13*b* is divided by the step portion 13*e* into the two portions of a lower leading end face 13*c* formed on the inner circumference side and a higher leading end face 13*d* formed on the outer circumference side, and a vertical joint face forming the step portion 12*e* is present between those adjoining leading end faces 13*c* and 13*d*.

The joint face constituting the step portion 12*e* is formed, as the spiral wrap 12*b* is viewed in the direction of the orbiting scroll member 13, into a semicircular shape, which joins smoothly into both the inner and outer side faces of the spiral wrap 12*b* and which has a diameter equal to the thickness of the spiral wrap 12*b*. Like the joint face constituting the step portion 12*e*, the joint face constituting the step portion 13*e* is formed, as the spiral wrap 13*b* is viewed in the direction of the orbiting scroll member 13, into a semicircular shape, which joins smoothly into both the inner and outer side faces of the spiral wrap 13*b* and which has a diameter equal to the thickness of the spiral wrap 13*b*.

The joint face constituting the step portion 12*h* is formed, as viewed in the orbiting axis direction of the end plate 12*a*, into an arc identical to an envelope, which is drawn by the joint face forming the step portion 13*e* as the orbiting scroll member 13 turns. The joint face constituting the step portion 13*h* is formed into an arc identical to an envelope, which is drawn by the joint face forming the step portion 12*e*.

Moreover, the spiral wrap 12*b* of the fixed scroll member 12 is equipped, at its leading end faces 12*c* and 12*d*, with such tip seal members 14*a* and 14*b* on the inner circumference side and the outer circumference side as are divided into two in the vicinity of the step portion 12*e*. Likewise, the spiral wrap 13*b* of the orbiting scroll member 13 is equipped, at its leading end faces 13*c* and 13*d*, with such tip seal members 15*a* and 15*b* on the inner circumference side and the outer circumference side as are divided into two in the vicinity of the step portion 13*e*.

Those tip seal members 14*a*, 14*b*, 15*a* and 15*b* are fitted in tip seal grooves 14*c*, 14*d*, 15*c* and 15*d*, which are formed in the leading end faces 12*c*, 12*d*, 13*c* and 13*d* of the spiral wraps 12*b* and 13*b*. Here, the tip seal members 14*a*, 14*b*, 15*a* and 15*b* are made of a resin such as, for example, PPS (polyphenylene sulfide), PEEK (polyether ether ketone) or PTFE (polytetrafluoroethylene).

The aforementioned tip seal members 14*a*, 14*b*, 15*a* and 15*b* seal, between the spiral scroll member 12 and the orbiting scroll member 13, the tip clearances formed between the leading end faces (the tip faces) 12*c* and 12*d*, and 13*c* and 13*d* and the bottom faces (the bottom lands) 12*f* and 12*g*, and 13*f* and 13*b* of the spiral wrap 12*b* and 13*b*, thereby to suppress the leakage of the compression gas from those tip clearances to the minimum. Specifically, when the orbiting scroll member 13 is assembled with the fixed scroll member 12, the tip seal member 15*a* disposed at the lower leading end face 13*c* abuts against the shallow bottom face 12*f*, and the tip seal member 15*b* disposed at the higher leading end face 13*d* abuts against the deeper bottom face 12*g*. Likewise, the tip seal member 14*a* disposed at the lower leading end face 12*c* abuts against the shallow bottom face 13*f*, and the tip seal member 14*b* disposed at the higher leading end face 12*d* abuts against the deeper bottom face 13*g*. As a result, between the two scroll members 12 and 13, there is formed the compression chamber C, which is limited by the end plates 12*a* and 13*a* confronting each other and the spiral wraps 12*b* and 13*b*. Here in FIG. 2A, the fixed scroll member 12 is shown upside down so as to illustrate the step shape of the fixed scroll member 12.

Figure 3:
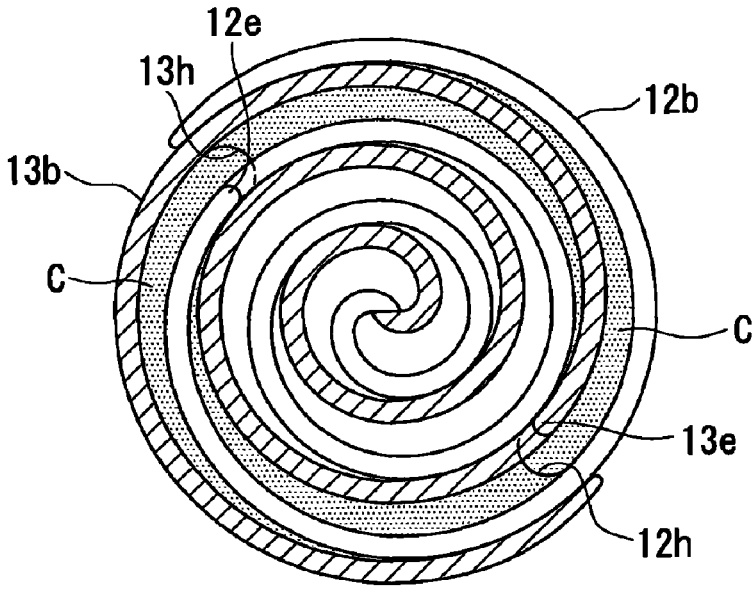
FIG. 3 is a top plan view of a meshing state between the fixed scroll member and the orbiting scroll member of the scroll compressor shown in FIG. 1.

FIG. 3 shows the state, in which the fixed scroll member 12 and the orbiting scroll member 13 are combined to form the compression chamber C, and in which the compression chamber C is fully sucked to start the compression. In this compression starting state, the outer circumference end of the spiral wrap 12*b* abuts against the outer side face of the spiral wrap 13*b*, and the outer circumference end of the spiral wrap 13*b* abuts against the outer side face of the spiral wrap 12*b*. The spaces between the end plates 12*a* and 13*a* and the spiral wraps 12*b* and 13*b* are filled with the gas to be compressed, so that the two compression chambers C of the maximum volume are formed at symmetric positions across the center of the compression mechanism 3. At this instant, the joint faces of the step portion 12*e* and the step portion 13*h*, and the step portion 13*e* and the step portion 12*h* are in sliding contact with each other, but leave each other just after the orbiting action of the orbiting scroll member 12.

Figure 4:
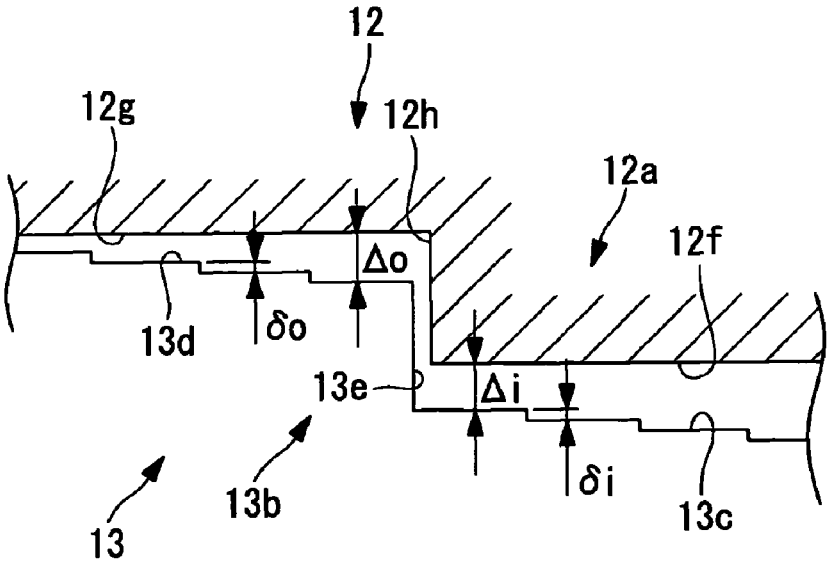
FIG. 4 is a constitution diagram of the spiral wrap leading end faces of the fixed scroll member and the orbiting scroll member of the scroll compressor shown in FIG. 1.

With the aforementioned fixed scroll member 12 and orbiting scroll member 13 being assembled with each other, moreover, the tip clearances to be described in the following are formed, as shown in FIG. 4, on the outer circumference side and the inner circumference side of the step portion 12*h* and the step portion 13*e*, under the room temperature before thermal influences are received. Here, the constitutions of the step portion 12*h* and the step portion 13*e* are described, but similar constitutions are adopted on the step portion 13*h* and the step portion 12*e*. Moreover, the tip clearances are at a level of, several tens μm, but are exaggeratedly shown for conveniences of illustrations.

Between the deeper bottom face 12*g* of the fixed scroll member 12 and the leading end face 13*d* of the spiral wrap 13*b* of the orbiting scroll member 13, as shown in FIG. 4, there is formed the tip clearance of the maximum $\Delta o$, which is gradually made the smaller as it comes the closer to the outer circumference side (the left-hand side, as shown) of the leading end face 13*d* of the spiral wrap 13*b*. In other words, the height (wrap height) of the leading end face 13*d* of the spiral wrap 13*b* is stepwise made gradually smaller at a constant height difference $\delta o$ toward the inner circumference side (the right-hand side, as shown) from the outer circumference side (the left-hand side, as shown). As a result, the tip clearance is stepwise made gradually larger toward the inner circumference side (the right-hand side, as shown) from the outer circumference side (the left-hand side, as shown).

Likewise, between the shallow bottom face 12*f* of the fixed scroll member 12 and the leading end face 13*c* of the spiral wrap 13*b* of the orbiting scroll member 13, there is formed the tip clearance of the minimum Δi, which is gradually made the larger as it comes the closer to the inner circumference side of the leading end face 13*c* of the spiral wrap 13*b*. In other words, the height (wrap height) of the leading end face 13*c* of the spiral wrap 13*b* is stepwise made gradually smaller at a constant height difference δi toward the inner circumference side (the right-hand side, as shown) from the outer circumference side (the left-hand side, as shown). As a result, the tip clearance is stepwise made gradually larger toward the inner circumference side (the right-hand side, as shown) from the outer circumference side (the left-hand side, as shown).

Moreover, the aforementioned relation between the tip clearances Δo and Δi is set to Δo≦Ai, and the aforementioned relation between the height differences δo and δi is set to δo=δi.

The following advantages can be attained according to the present embodiment thus far described.

The scroll compressor S of the present embodiment is constituted such that the fixed scroll member 12 and the orbiting scroll member 13 have the step portions 12*e* and 12*h* and the step portions 13*e* and 13*h* between the leading end faces 12*c* and 12*d*, and 13*c* and 13*d* and between the bottom faces 12*f* and 12*g*, and 13*f* and 13*g* of the individual spiral wraps 12*b* and 13*b*, and such that the wrap heights on the outer circumference sides of the spiral wraps 12*b* and 13*b* are made larger than the wrap heights on the inner circumference sides. As a result, the so-called three-dimensional compressions are performed in the circumferential directions and the wrap height directions of the spiral wraps 12*b* and 13*b*. In this meanwhile, the coolant gas to be compressed is raised in temperature at a substantially continuous temperature gradient from the intake position to the discharge position. Accordingly, the scroll members 12 and 13 are also raised in temperature so that the spiral wraps 12*b* and 13*b* are thermally expanded in proportion to their temperature and length (height).

On the other hand, the coolant gas is substantially proportionally raised in pressure while it is being compressed from an intake pressure to a discharge pressure, so that the reaction against the compression acts on the end plates 12*a* and 13*a*. In the general scroll compressor, the end plates 12*a* and 13*a*, in which the compression is substantially proportionally raised, are largely warped at their central portions by that compression reaction, whereas the outer circumference sides are gradually less warped. In the aforementioned scroll compressor S, however, the end plates 12*a* and 13*a* are made thicker on the inner circumference side with respect to the step portions 12*h* and 13*h* so that the pressure deformation (warpage) at the end plate central portions is not so large. Therefore, it is thought that the influences to be given to the tip clearances by the thermal expansion and the pressure deformation at a compression running time are dominated by the substantially influences due to the thermal expansion.

In the present embodiment, the tip clearance between the shallow bottom face 12*g* of the fixed scroll member 12 and the spiral wrap leading end face 13*d* of the orbiting scroll member 13 is stepwise made gradually larger from the outer circumference side to the inner circumference side, and the tip clearance between the shallow bottom face 12*f* of the fixed scroll member 12 and the spiral wrap leading end face 13*c* of the orbiting scroll member 13 is stepwise made gradually larger from the outer circumference side to the inner circumference side. In a manner to match the aforementioned continuous temperature gradient from the intake to the discharge, therefore, the tip clearances of the leading end faces 12*c* and 12*d*, and 13*c* and 13*d* of the spiral wraps 12*b* and 13*b* in the spiral direction can be optimized over the whole range thereby to make the tip clearances as small as possible as a whole.

In the whole range from the intake to the discharge, therefore, the gas leakages from the tip clearances can be reduced to improve the compression efficiency thereby to give a high performance to the scroll compressor capable of performing the three-dimensional compressions.

Moreover, the relation between the maximum tip clearance Δo between the bottom face 12*g* and the leading end face 13*d* and the minimum tip clearance Δi between the bottom face 12*f* and the leading end face 13*c* is made Δo≦Δi, so that the tip clearances of the spiral wraps 12*b* and 13*b* from the outermost circumference and the innermost circumference can be stepwise made gradually larger. As a result, the tip clearances in operation all over the ranges from the outermost circumference to the innermost circumference of the spiral wraps 12*b* and 13*b* can be optimized and made as small as possible.

Here, in the aforementioned description, the tip clearance between the bottom face 12*g* and the leading end face 13*d* and the tip clearance between the bottom face 12*f* and the leading end face 13*c* are individually stepwise made gradually larger from the outer circumference side to the inner circumference side. However, the tip clearance between the bottom face 12*g* and the leading end face 13*d* is set to the constant tip clearance Δo, and only the tip clearance Δi between the bottom face 12*f* and the leading end face 13*c* may be stepwise made gradually larger from the outer circumference side to the inner circumference side. Thus, the tip clearances are stepwise varied only on the inner circumference sides with respect to the step portions 12*h* and 13*e* and the step portions 12*e* and 13*h*, so that the tip clearances in operation in the spiral direction of the inner circumference side with respect to the step portions of the spiral wraps 12*b* and 13*b* can be optimized and reduced in a manner to match the continuous temperature gradient in the high-pressure and high-temperature range. As a result, the gas leakages from the tip clearance Δi in the high-pressure range can be reduced to improve the compression efficiency effectively thereby to give a high performance to the scroll compressor S capable of performing the three-dimensional compressions.

Second Embodiment

Figure 5:
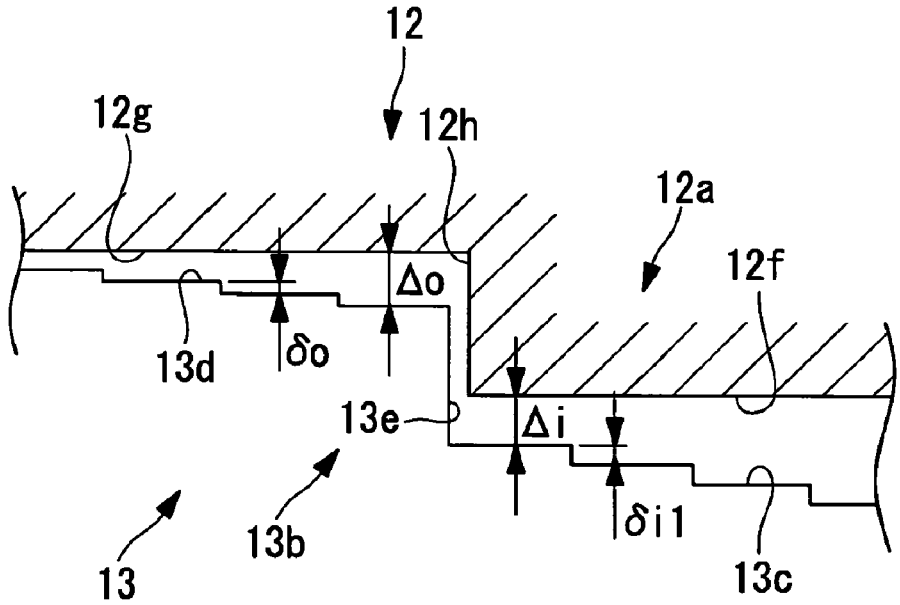
FIG. 5 is a constitution diagram of the spiral wrap leading end portions of the fixed scroll member and the orbiting scroll member of a scroll compressor according to a second embodiment of the present invention.

Next, a second embodiment of the present invention is described with reference to FIG. 5.

The present embodiment is different from the aforementioned first embodiment in how the heights (or the wrap heights) of the leading end faces of the spiral wraps 12*b* and 13*b* are stepwise varied. The remaining points are similar to those of the first embodiment so that their descriptions are omitted.

In the aforementioned first embodiment, the leading end faces 12*c* and 12*d* and the leading end faces 13*c* and 13*d* are stepwise varied in heights individually with constant height differences δo and δi (δo=δi). In the present embodiment, however, the height difference δi1 between the leading end faces 12*c* and 13*c* on the inner circumference side is made larger than the height difference δo (δo<δi1) between the leading end faces 12*d* and 13*d* on the outer circumference side of the step portions 12*e* and 13*e* of the individual spiral wraps 12*b* and 13*b*.

The height difference δi1 of the leading end faces 12*c* and 13*c* on the inner circumference side is made larger than the height difference δo (δo<δi1) of the leading end faces 12*d* and 13*d* on the outer circumference side, as described above. As a result, the relation between the gradient (Eo) at the time when the heights of the leading end faces 12*d* and 13*d* on the outer circumference side are gradually made smaller toward the center side and the gradient (Ei) at the time when the heights of the leading end faces 12*c* and 13*c* on the inner circumference side are gradually made smaller toward the center side can be set at Eo<Ei.

As a result, the tip clearances from the outermost circumferences to the innermost circumferences of the spiral wraps 12*b* and 13*b* can be stepwise made gradually larger. Especially in the high-temperature range on the inner circumference side with respect to the step portions 12*e* and 13*e* of the larger temperature gradient, the tip clearance Δi can be stepwise made gradually larger at the larger gradient (Ei). Therefore, the tip clearances in operation over the whole range from the outermost circumference to the innermost circumference of the spiral wraps can be optimized and reduced as a whole.

Third Embodiment

Figure 6:
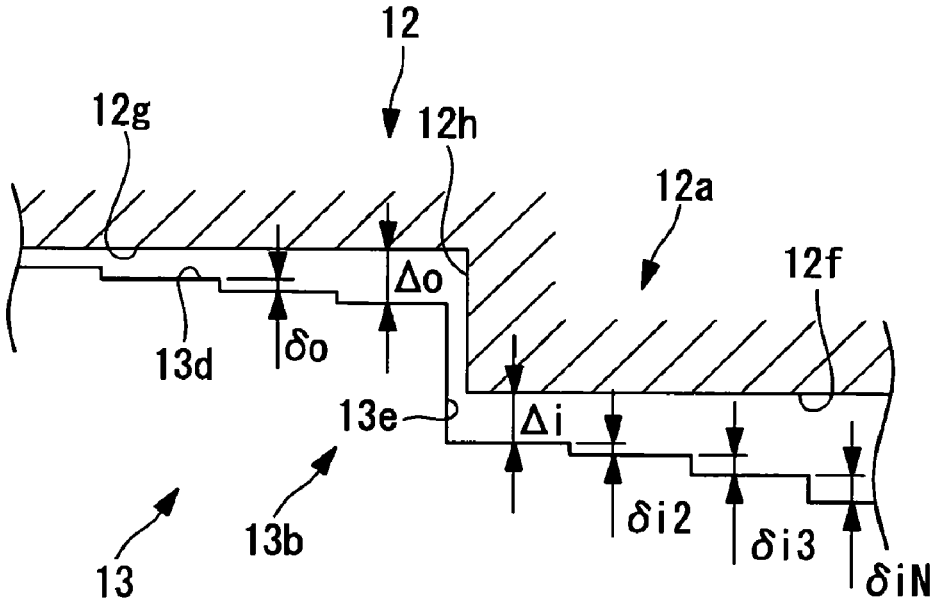
FIG. 6 is a constitution diagram of the spiral wrap leading end portions of the fixed scroll member and the orbiting scroll member of a scroll compressor according to a third embodiment of the present invention.

Next, a third embodiment of the present invention is described with reference to FIG. 6.

The present embodiment is different from the aforementioned first and second embodiments in how the heights (wrap heights) of the leading end faces of the spiral wraps 12*b* and 13*b* are stepwise varied. The remaining points are similar to those of the first and second embodiments so that their descriptions are omitted.

In the present embodiment, the leading end faces 12*d* and 13*d* on the outer circumference side are stepwise varied in heights at a constant height difference δo, but the leading end faces 12*c* and 13*c* on the inner circumference side are gradually made larger at height differences δi2, δi3 and δiN (δi2<δi3<δiN) toward the center side.

As described above, the height differences δi2, δi3 and δiN (δi2<δi3<δiN) of the leading end faces 12*c* and 13*c* on the inner circumference side are gradually made larger toward the center side, so that the gradient (Ei) at the time when the heights of the leading end faces 12*c* and 13*c* on the inner circumference side are stepwise made gradually larger toward the center side can be gradually made larger toward the center side.

As a result, the tip clearances of the spiral wraps 12*b* and 13*b* from the outermost circumference to the innermost circumference can be stepwise made gradually larger. Especially on the inner circumference side with respect to the step portions 12*e* and 13*e* of the large temperature gradient, the tip clearance Δi can be stepwise made gradually larger at the larger gradient (Ei). Therefore, the tip clearances in operation over the whole range from the outermost circumference to the innermost circumference of the spiral wraps can be optimized and reduced as a whole.

Fourth Embodiment

Figure 7:
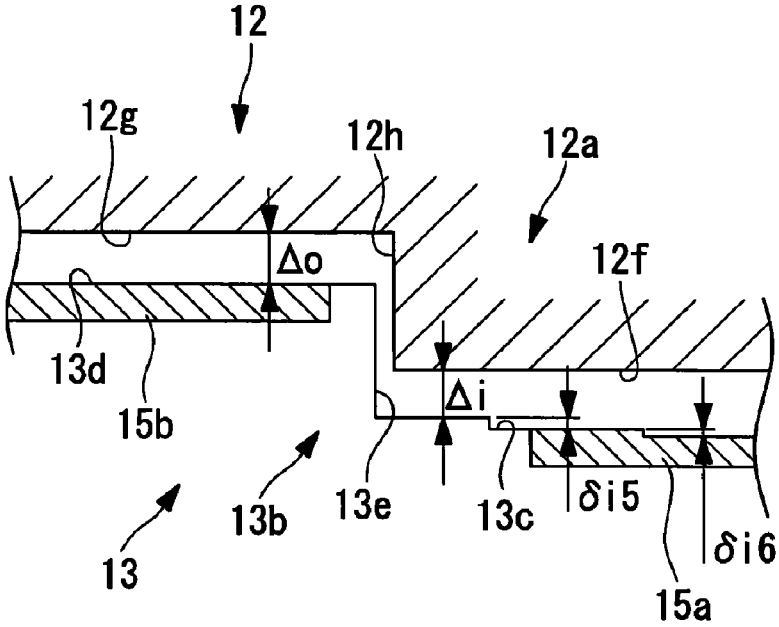
FIG. 7 is a constitution diagram of the spiral wrap leading end portions of the fixed scroll member and the orbiting scroll member of a scroll compressor according to a fourth embodiment of the present invention.

Next, a fourth embodiment of the present invention is described with reference to FIG. 7.

The present embodiment is different from the aforementioned first to third embodiments in how to make the steps of the inner circumference side leading end faces 12*c* and 13*c* in the spiral wraps 12*b* and 13*b*. The remaining points are similar to those of the first to third embodiments so that their descriptions are omitted.

In the present embodiment, in the leading end faces 12*c* and 13*c* on the inner circumference side, there is formed one of the height differences δi for varying the tip clearance stepwise is formed in the vicinity of the outer circumference end side of the position where the tip seal members 14*a* and 15*a* are fitted. That height difference δi5 is made larger than others δi6 and δiN.

Thus, that one height difference δi5 is formed in the vicinity of the outer circumference end side of the position where the tip seal members 14*a* and 15*a* of the inner circumference side leading end faces 12*c* and 13*c* are fitted, so that the tip clearance Δi at that portion can be reduced. Especially, the height difference δi5 is made larger than the other ones δi6 and δiN, so that the tip clearances at the cut portions of the tip seal members 14*a* and 15*a* can be more effectively reduced. As a result, the gas leakage at that portion can be reduced to improve the compression efficiency.

Fifth Embodiment

Next, a fifth embodiment of the present invention is described with reference to FIG. 8.

The present embodiment is different from the aforementioned first to fourth embodiments in the fitting structures of the tip seal members 14*a*, 14*b*, 15*a* and 15*b* to be fitted on the leading end faces 12*c*, 12*d*, 13*c* and 13*d* of the spiral wraps 12*b* and 13*b*. The remaining points are similar to those of the first embodiment so that their descriptions are omitted.

Figure 8:
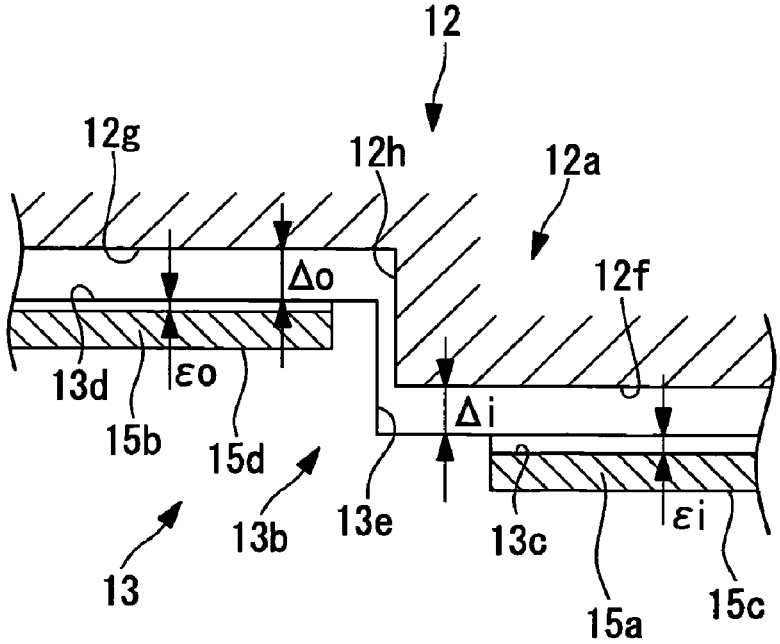
FIG. 8 is a constitution diagram of the spiral wrap leading end portions of the fixed scroll member and the orbiting scroll member of a scroll compressor according to a fifth embodiment of the present invention.

In the present embodiment, as shown in FIG. 8, when the height difference between the top faces of the outer circumference side tip seal members 14*b* and 15*b* to be fitted in the tip seal grooves 14*d* and 15*d* on the outer circumference side with respect to the step portions 12*e* and 13*e* of the spiral wraps 12*b* and 13*b* and the wrap leading end faces 12*d* and 13*d* is designated by εo, and when the height difference between the top faces of the inner circumference side tip seal members 14*a* and 15*a* to be fitted in the tip seal grooves 14*c* and 15*c* on the inner circumference side with respect to the step portions 12*e* and 13*e* and the wrap leading end faces 12*c* and 13*c* is designated by εi, the relation between the height differences εo and εi is set to εo<εi.

The aforementioned tip seal members 14*a*, 14*b*, 15*a* and 15*b* are made of a resin, as described hereinbefore, and have a larger linear expansion coefficient than that of the metallic spiral wraps 12*b* and 13*b*. In the present embodiment, correspondingly, the height difference εo between the top faces of the outer circumference side tip seal members 14*b* and 15*b* and the wrap leading end faces 12*d* and 13*d* and the height difference εi between the top faces of the inner circumference side tip seal members 14*a* and 15*a* and the wrap leading end faces 12*c* and 13*c* are set to have the relation of εo<εi. Therefore, the tip clearances, which are determined by the thermal expansions of the tip seal members 14*a*, 14*b*, 15*a* and 15*b*, in operation of the spiral wraps 12*b* and 13*b* on the outer circumference side and the inner circumference side with respect to the step portions 12*e* and 13*e*, that is, the tip clearances between the top faces of the tip seal members 14*a*, 14*b*, 15*a* and 15*b* and the bottom faces 12*f*, 12*g*, 13*f* and 13*g* of the mating scroll members 12 and 13 are individually optimized so that the tip clearances can be reduced as a whole.

As a result, the gas leakages from the tip clearances can be reduced to improve the compression efficiency thereby to give a high performance to the scroll compressor capable of performing the three-dimensional compressions.

Sixth Embodiment

Next, a sixth embodiment of the present invention is described with reference to FIG. 9.

The present embodiment is different from the aforementioned fifth embodiment in that the tip seal grooves 14*c*, 14*d*, and 15*c* and 15*d* are stepwise made gradually deeper toward the center sides of the spiral wraps 12*b* and 13*b*. The remaining points are similar to those of the fifth embodiment so that their descriptions are omitted.

Figure 9:
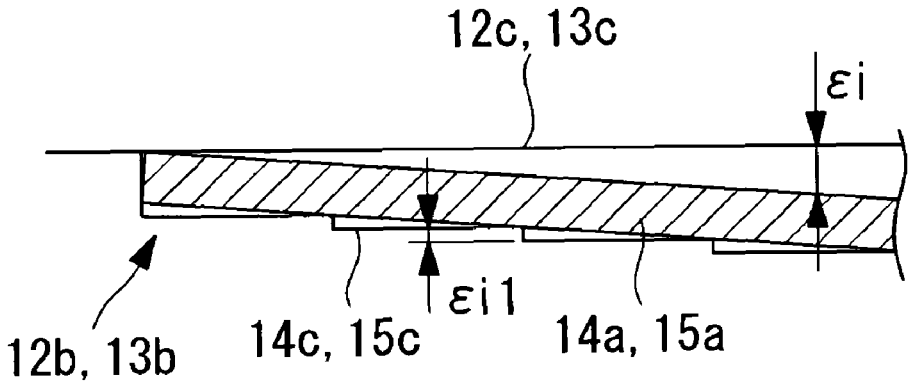
FIG. 9 is a constitution diagram of the spiral wrap leading end portions of the fixed scroll member and the orbiting scroll member of a scroll compressor according to a sixth embodiment of the present invention.

In FIG. 9, the tip seal grooves 14*c* and 15*c* on the inner circumference side with respect to the step portions 12*e* and 13*e* of the spiral wraps 12*b* and 13*b* are stepwise made gradually deeper at a constant height difference $\epsilon i1$ toward the center sides of the spiral wraps 12*b* and 13*b*, and the height difference $\epsilon i$ between the top faces of the inner circumference side tip seal members 14*a* and 15*a* and the wrap leading end faces 12*c* and 13*c* is made gradually larger toward the center sides of the spiral wraps 12*b* and 13*b*.

The thermal expansions of the inner circumference side tip seal members 14*a* and 15*a* become larger toward the center side of the spiral direction. As described above, correspondingly, the height difference $\epsilon i$ between the top faces of the inner circumference side tip seal members 14*a* and 15*a* with respect to the step portions 12*e* and 13*e* and the wrap leading end faces 12*c* and 13*c* is made gradually larger toward the center sides of the spiral wraps 12*b* and 13*b*. In a manner to match the continuous temperature gradient in the high-temperature range in the high-pressure range, therefore, the tip clearances, which are determined by the thermal expansions of the tip seal members 14*a* and 15*a*, in operation in the spiral directions of the spiral wraps 12*b* and 13*b* on the inner circumference side with respect to the step portions 12*e* and 13*e*, that is, the tip clearances between the top faces of the tip seal members 14*a* and 15*a* and the bottom faces 12*f* and 13*f* of the mating scroll members 12 and 13 can be optimized and reduced.

Therefore, the gas leakages from the tip clearances in the high-pressure ranges can be reduced to improve the compression efficiency effectively.

Here, the foregoing description has been made on the embodiment, in which the tip seal grooves 14*c* and 15*c* on the inner circumference side with respect to the step portions 12*e* and 13*e* are stepwise made gradually deeper at the constant height difference $\epsilon i1$ toward the center sides of the spiral wraps 12*b* and 13*b*. Like the above, however, the tip seal grooves 14*d* and 15*d* on the outer circumference side with respect to the step portions 12*e* and 13*e* may also be stepwise made gradually deeper at a constant height difference $\epsilon o1$ (although not shown) toward the inner circumference side, and the height difference $\epsilon o$ (although not shown) between the top faces of the outer circumference side tip seal members 14*b* and 15*b* and the wrap leading end faces 12*d* and 13*d* may also be made gradually larger toward the center sides of the spiral wraps 12*b* and 13*b*.

As described above, the height differences $\epsilon o$ and $\epsilon i$ in the outer circumference side tip seal members 14*b* and 15*b* and the inner circumference side tip seal members 14*a* and 15*a* can be made gradually larger toward the center sides from the outer circumference sides of the spiral wraps. In a manner to match the continuous temperature gradient from the intake to the discharge, therefore, the tip clearances, which are determined by the thermal expansions of the tip seal members 14*a*, 14*b*, 15*a* and 15*b*, in operation in the spiral directions of the outer circumference side and inner circumference side spiral wraps 12*b* and 13*b*, that is, the tip clearances between the top faces of the tip seal members 14*a*, 14*b*, 15*a* and 15*b* and the bottom faces 12*f*, 12*g*, 13*f* and 13*g* of the mating scroll members 12 and 13 can be optimized over the whole range and reduced.

Therefore, the gas leakages from the tip clearances in the whole range from the intake to the discharge can be reduced to improve the compression efficiency.

Seventh Embodiment

Next, a seventh embodiment of the present invention is described with reference to FIG. 10.

The present embodiment is different from the aforementioned fifth and sixth embodiments in that the tip seal grooves 14*c* and 14*d*, and 15*c* and 15*d* are stepwise made gradually deeper toward the center sides of the spiral wraps 12*b* and 13*b*, and in that the leading end faces 12*c* and 12*d*, and 13*c* and 13*d* of the spiral wraps 12*b* and 13*b* are stepwise made gradually lower (in the wrap heights) toward the center sides. The remaining points are similar to those of the fifth and sixth embodiments so that their descriptions are omitted.

Figure 10:
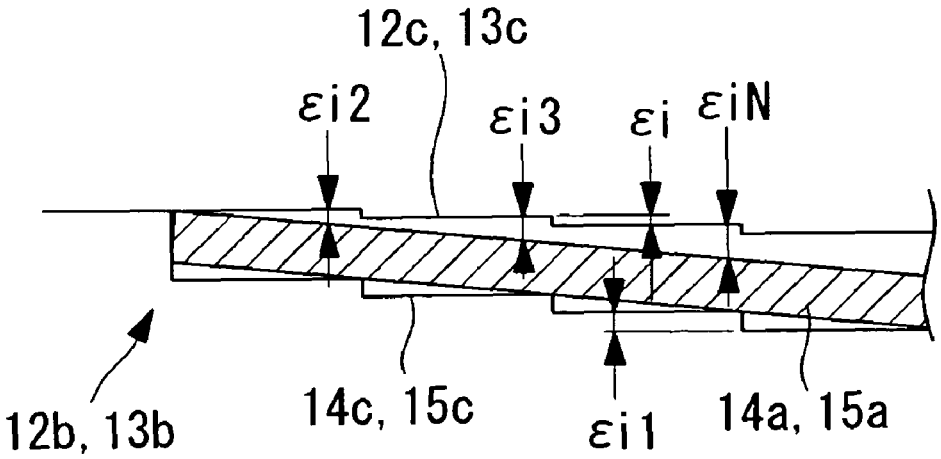
FIG. 10 is a constitution diagram of the spiral wrap leading end portions of the fixed scroll member and the orbiting scroll member of a scroll compressor according to a seventh embodiment of the present invention.

As shown in FIG. 10, the tip seal grooves 14*c* and 15*c* on the inner circumference side with respect to the step portions 12*e* and 13*e* of the spiral wraps 12*b* and 13*b* are stepwise made gradually deeper at the constant height difference $\epsilon i1$ toward the center sides of the spiral wraps 12*b* and 13*b*, and the leading end faces 12*c* and 13*c* of the spiral wraps 12*b* and 13*b* are stepwise made gradually lower (in the wrap heights) at the constant height difference $\delta i$ toward the center sides, so that the height difference $\epsilon i$ between the top faces of the inner circumference side tip seal members 14*a* and 15*a* and the wrap leading end faces 12*c* and 13*c* is stepwise made gradually larger to $\epsilon i2<\epsilon i3<\epsilon iN$ toward the center sides of the spiral wraps 12*b* and 13*b*. In other words, the height difference $\epsilon i1$ of the tip seal grooves 14*c* and 15*c* is made larger than the height difference $\delta i$ of the leading end faces 12*c* and 13*c* ($\delta i<\epsilon i1$), and the gradient (Eg) at the time when the tip seal grooves 14*c* and 15*c* are stepwise made deeper than the gradient (Er) at the time when the leading end faces 12*c* and 13*c* are stepwise made lower (Er<Eg), so that the height differences $\epsilon i$ between the top faces of the inner circumference side tip seal members 14*a* and 15*a* and the wrap leading end faces 12*c* and 13*c* are stepwise made larger toward the center side ($\epsilon i2<\epsilon i3<\epsilon iN$).

In a manner to match the continuous temperature gradient in the high-temperature range in the high-pressure range, therefore, the tip clearances, which are determined by the thermal expansions of the tip seal members 14*a* and 15*a*, in operation in the spiral directions of the spiral wraps 12*b* and 13*b* on the inner circumference sides with respect to the step portions 12*e* and 13*e*, that is, the tip clearances between the top faces of the tip seal members 14*a* and 15*a* and the bottom faces 12*f* and 13*f* of the mating scroll members 12 and 13 can be optimized and reduced.

Therefore, the gas leakages from the tip clearances in the high-pressure ranges can be reduced to improve the compression efficiency effectively.

Here, the foregoing description has been made on the embodiment, in which the depths of the tip seal grooves 14*c* and 15*c* on the inner circumference side with respect to the step portions 12*e* and 13*e* and the heights of the leading end faces 12*c* and 13*c* of the spiral wraps 12*b* and 13*b* are stepwise varied. Like the above, however, the depths and the heights of the tip seal grooves 14*d* and 15*d* on the outer circumference side with respect to the step portions 12*e* and 13*e* and the leading end faces 12*d* and 13*d* of the spiral wraps 12*b* and 13*b* may also be stepwise varied, so that the height differences $\epsilon 0$ (not shown) toward the inner circumference side between the top faces of the outer circumference side tip seal members 14*b* and 15*b* and the wrap leading end faces 12*d* and 13*d* may also be stepwise made gradually larger toward the inner circumference sides of the spiral wraps 12*b* and 13*b*.

In a manner to match the continuous temperature gradient from the intake to the discharge, therefore, the tip clearances, which are determined by the thermal expansions of the tip seal members 14*a*, 14*b*, 15*a* and 15*b*, in operation in the spiral directions of the outer circumference side and inner circumference side spiral wraps 12*b* and 13*b*, that is, the tip clearances between the top faces of the tip seal members 14*a*, 14*b*, 15*a* and 15*b* and the bottom faces 12*f*, 12*g*, 13*f* and 13*g* of the mating scroll members 12 and 13 can be optimized over the whole range and reduced.

Therefore, the gas leakages from the tip clearances in the whole range from the intake to the discharge can be reduced to improve the compression efficiency.

Eighth Embodiment

Next, an eighth embodiment of the present invention is described with reference to FIG. 9 and FIG. 10.

In the present embodiment, the leading end faces 12*d* and 13*d* on the outer circumference side with respect to the step portions 12*e* and 13*e* of the individual spiral wraps 12*b* and 13*b* and the tip seal grooves 14*d* and 15*d* take the mode shown in FIG. 9, and the leading end faces 12*c* and 13*c* on the inner circumference side with respect to the step portions 12*e* and 13*e* and the tip seal grooves 14*c* and 15*c* take the mode shown in FIG. 10.

With the constitution thus far described, in a manner to match the relatively smaller outer circumference side temperature gradient and the relatively larger inner circumference side temperature gradient, the tip clearances in operation on the outer circumference side and the inner circumference side with respect to the step portions 12*e* and 13*e* of the spiral wraps can be optimized to match the individual temperature gradients so that the tip clearances in operation can be made as small as possible.

Therefore, the gas leakages from the tip clearances in the whole range from the intake to the discharge can be reduced to improve the compression efficiency.

Here, in the individual embodiments thus far described, the heights of the leading end faces 12*c*, 12*d*, 13*c* and 13*d* of the individual spiral wraps 12*b* and 13*b* and the depths of the tip seal grooves 14*c*, 14*d*, 15*c* and 15*d* are individually stepwise varied, but may also be continuously varied in a taper shape.

Moreover, the present invention should not be limited to the aforementioned embodiments, but can be suitably modified within the scope not departing from the gist of the present invention.

The invention claimed is:

1. A scroll compressor comprising:

a fixed scroll member having a fixed spiral wrap erected on one face of a fixed end plate; and an orbiting scroll member having an orbiting spiral wrap erected on one face of an orbiting end plate and assembled in a manner for orbiting, while being blocked from rotations, with respect to the fixed scroll member, each of the fixed scroll member and the orbiting scroll member including a step portion on a leading end face and a bottom face of the spiral wrap such that the spiral wrap has a higher wrap height on the outer circumference side than that on the inner circumference side, and the scroll compressor being enabled to perform three-dimensional compressions for compressing in the circumferential direction of the spiral wrap and in the wrap height direction, wherein the spiral wrap, at least on the inner circumference side with respect to the step portion, is stepwise or continuously made gradually lower toward the center side of the spiral wrap, and wherein a tip clearance of the spiral wrap, at least on the inner circumference side with respect to the step portion, is made gradually larger toward the center side of the spiral wrap, and wherein the gradient at the time when the spiral wrap on the inner circumference side with respect to the step portion is stepwise or continuously made gradually lower toward the center side of the spiral wrap is made gradually larger toward the center side of the spiral wrap.

2. A scroll compressor according to claim 1, wherein a maximum tip clearance $\Delta o$ of the spiral wrap on the outer circumference side with respect to the step portion and the minimum tip clearance $\Delta i$ of the spiral wrap on the inner circumference side with respect to the step portion are made to have a relation of $\Delta o<\Delta i$.

3. A scroll compressor comprising:

a fixed scroll member having a fixed spiral wrap erected on one face of a fixed end plate; and an orbiting scroll member having an orbiting spiral wrap erected on one face of an orbiting end plate and assembled in a manner for orbiting, while being blocked from rotations, with respect to the fixed scroll member, each of the fixed scroll member and the orbiting scroll member including a step portion on a leading end face and a bottom face of the spiral wrap such that the spiral wrap has a higher wrap height on the outer circumference side than that on the inner circumference side, and the scroll compressor being enabled to perform three-dimensional compressions for compressing in the circumferential direction of the spiral wrap and in the wrap height direction, wherein each of the spiral wrap on the outer circumference side with respect to the step portion and the spiral wrap on the inner circumference side is stepwise or continuously made gradually lower toward the center side of the spiral wrap, and wherein a tip clearance of the spiral wrap is made gradually larger from the outer circumference side of the spiral wrap toward the center side, and wherein the gradient at the time when the spiral wrap on the inner circumference side with respect to the step \portion is stepwise or continuously made gradually lower toward the center side of the spiral wrap is made gradually larger toward the center side of the spiral wrap.

4. A scroll compressor according to claim 3, wherein a gradient Eo at the time when the spiral wrap on the outer circumference side with respect to the step portion is stepwise or continuously made gradually lower toward the center side of the spiral wrap and a gradient Ei at the time when the spiral wrap on the inner circumference side with respect to the step portion is stepwise or continuously made gradually lower toward the center side of the spiral wrap are made to have a relation of $Eo<Ei$.

5. A scroll compressor according to claim 3, wherein a maximum tip clearance Ao of the spiral wrap on the outer circumference side with respect to the step portion and the minimum tip clearance Ai of the spiral wrap on the inner circumference side with respect to the step portion are made to have a relation of $Ao \leqq Ai$.

6. A scroll compressor comprising:

a fixed scroll member having a fixed spiral wrap erected on one face of a fixed end plate; and an orbiting scroll member having an orbiting spiral wrap erected on one face of an orbiting end plate and assembled in a manner for orbiting, while being blocked from rotations, with respect to the fixed scroll member, each of the fixed scroll member and the orbiting scroll member including a step portion on a leading end face and a bottom face of the spiral wrap such that the spiral wrap has a higher wrap height on the outer circumference side, and the scroll compressor being enabled to perform three-dimensional compressions for compressing in the circumferential direction of the spiral wrap and in the wrap height direction, wherein the spiral wrap, at least on the inner circumference side with respect to the step portion, is stepwise or continuously made gradually lower toward the center side of the spiral wrap, and wherein a tip clearance of the spiral wrap, at least on the inner circumference side with respect to he step portion , is made gradually larger toward the center side of the spiral wrap, wherein a tip seal member is fitted in a tip seal groove formed in the leading end face of the spiral wrap, at least on the inner circumference side with respect to the step portion, and wherein one of height differences for varying the tip clearance stepwise is disposed in the vicinity of the outer circumference end side at the position where the tip seal member is fitted, and wherein the height difference is made higher than the other height differences for varying the tip clearance stepwise.

7. A scroll compressor comprising:

a fixed scroll member having a fixed spiral wrap erected on one face of a fixed end plate; and an orbiting scroll member having an orbiting spiral wrap erected on one face of an orbiting end plate and assembled in a manner capable of orbiting, while being blocked from rotations, with regard to the fixed scroll member, each of the fixed scroll member and the orbiting scroll member including a step portion on the leading end face and the bottom face of the spiral wrap such that the spiral wrap has a higher wrap height on the outer circumference side than that on the inner circumference side, a tip seal member being fitted in a tip seal groove formed in the leading end face of the spiral wrap, and the scroll compressor being enabled to perform three-dimensional compressions capable of compressing in the circumferential direction of the spiral wrap and in the wrap height direction, wherein the height difference $\epsilon o$ between the top face of the outer circumference side tip seal member fitted in the spiral wrap on the outer circumference side with respect to the step portion and the wrap leading end face, and the height difference $\epsilon i$ between the top face of the inner circumference side tip seal member fitted in the spiral wrap on the inner circumference side with respect to the step portion and the wrap leading end face are made to have a relation of $\epsilon o<\epsilon i$.

8. A scroll compressor according to claim 7, wherein the inner circumference side tip seal groove formed in the spiral wrap on the inner circumference side with respect to the step portion is stepwise or continuously made gradually deeper toward the center side of the spiral wrap, and wherein the height difference Si is made gradually larger from the outer circumference side of the spiral wrap toward the center side.

9. A scroll compressor according to claim 8, wherein, in a manner to match the fact that the inner circumference side tip seal groove is stepwise or continuously made gradually deeper toward the center side of the spiral wrap, the spiral wrap on the inner circumference side with respect to the step portion is stepwise or continuously made gradually lower toward the center side of the spiral wrap, and wherein a gradient Eg at the time when the inner circumference side tip seal groove is stepwise or continuously made gradually deeper toward the center side of the spiral wrap and a gradient Er at the time when the spiral wrap is stepwise or continuously made gradually lower toward the center side of the spiral wrap are made to have a relation of Eg>Er.

10. A scroll compressor according to claim 8, wherein, in a manner to match the fact that each of the inner circumference side tip seal groove and the outer circumference side tip seal groove is stepwise or continuously made gradually deeper toward the center side of the spiral wrap, each of the spiral wrap on the inner circumference side and the spiral wrap on the outer circumference side is stepwise or continuously made gradually lower toward the center side of the spiral wrap, and wherein a gradient Eg at the time when each of the inner circumference side tip seal groove and the outer circumference side tip seal groove is stepwise or continuously made gradually deeper toward the center side of the spiral wrap and a gradient Er at the time when the inner circumference side spiral wrap and the outer circumference side spiral wrap is stepwise or continuously made gradually lower toward the center side of the spiral wrap are made to have a relation of Eg>Er.

11. A scroll compressor according to claim 7, wherein each of the outer circumference side tip seal groove formed in the spiral wrap on the outer circumference side with respect to the step portion and the inner circumference side tip seal groove formed in the spiral wrap on the inner circumference side with respect to the step portion is stepwise or continuously made gradually deeper toward the center side of the spiral wrap, and wherein each of the height differences so and $\epsilon i$ is made gradually larger from the outer circumference side of the spiral wrap toward the center side.

12. A scroll compressor according to claim 11, wherein, in a manner to match the fact that the inner circumference side tip seal groove is stepwise or continuously made gradually deeper toward the center side of the spiral wrap, the spiral wrap on the inner circumference side with respect to the step portion is stepwise or continuously made gradually lower toward the center side of the spiral wrap, and wherein a gradient Eg at the time when the inner circumference side tip seal groove is stepwise or continuously made gradually deeper toward the center side of the spiral wrap and a gradient Er at the time when the spiral wrap is stepwise or continuously made gradually lower toward the center side of the spiral wrap are made to have a relation of Eg>Er.

13. A scroll compressor according to claim 11, wherein, in a manner to match the fact that each of the inner circumference side tip seal groove and the outer circumference side tip seal groove is stepwise or continuously made gradually deeper toward the center side of the spiral wrap, each of the spiral wrap on the inner circumference side and the spiral wrap on the outer circumference side is stepwise or continuously made gradually lower toward the center side of the spiral wrap, and wherein a gradient Eg at the time when each of the inner circumference side tip seal groove and the outer circumference side tip seal groove is stepwise or continuously made gradually deeper toward the center side of the spiral wrap and a gradient Er at the time when the inner circumference side spiral wrap and the outer circumference side spiral wrap is stepwise or continuously made gradually lower toward the center side of the spiral wrap are made to have a relation of Eg>Er.

14. A scroll compressor according to claim 7, wherein the outer circumference side tip seal groove formed in the spiral wrap on the outer circumference side with respect to the step portion is stepwise or continuously made gradually deeper toward the center side of the spiral wrap, wherein the height difference co is made gradually larger from the outer circumference side to the inner circumference side of the spiral wrap, wherein, in a manner to match the fact that the tip seal groove formed in the inner circumference side spiral wrap with respect to the step portion is stepwise or continuously made gradually deeper toward the center side of the spiral wrap, the spiral wrap on the inner circumference side with respect to the step portion is stepwise or continuously made gradually lower toward the center side of the spiral wrap, and wherein a gradient Eg at the time when the inner circumference side tip seal groove is stepwise or continuously made gradually deeper toward the center side of the spiral wrap and a gradient Er at the time when the spiral wrap is stepwise or continuously made gradually lower toward the center side of the spiral wrap are made to have a relation of Eg>Er.

15. A scroll compressor comprising:

a fixed scroll member having a fixed spiral wrap erected on one face of a fixed end plate; and an orbiting scroll member having an orbiting spiral wrap erected on one face of an orbiting end plate and assembled in a manner for orbiting, while being blocked from rotations, with respect to the fixed scroll member, each of the fixed scroll member and the orbiting scroll member including a step portion on a leading end face and a bottom face of the spiral wrap such that the spiral wrap has a higher wrap height on the outer circumference side than that on the inner circumference side, and the scroll compressor being enabled to perform three-dimensional compressions for compressing in the circumferential direction of the spiral wrap and in the wrap height direction, wherein each of the spiral wrap on the outer circumference side with respect to the step portion and the spiral wrap on the inner circumference side is stepwise or continuously made gradually lower toward the center side of the spiral wrap, and wherein a tip clearance of the spiral wrap is made gradually larger from the outer circumference side of the spiral wrap toward the center side, wherein a tip seal member is fitted in a tip seal groove formed in the leading end face of the spiral wrap, at least on the inner circumference side with respect to the step portion, and wherein one of height differences for varying the tip clearance stepwise is disposed in the vicinity of the outer circumference end side at the position where the tip seal member is fitted, and wherein the height difference is made higher than the other height differences for varying the tip clearance stepwise.

* * * * *